US006310511B1

(12) United States Patent
Weinfurtner

(10) Patent No.: US 6,310,511 B1
(45) Date of Patent: Oct. 30, 2001

(54) GENERATOR SCHEME AND CIRCUIT FOR OVERCOMING RESISTIVE VOLTAGE DROP ON POWER SUPPLY CIRCUITS ON CHIPS

(75) Inventor: Oliver Weinfurtner, Wappingers Falls, NY (US)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/595,696

(22) Filed: Jun. 16, 2000

(51) Int. Cl.[7] ..... G05F 1/10; G05F 3/02

(52) U.S. Cl. ..... 327/540; 365/226; 365/189.11; 327/543

(58) Field of Search ..... 327/538, 540, 327/541, 543; 365/226, 189.11; 323/316

(56) References Cited

U.S. PATENT DOCUMENTS 5,373,477 * 12/1994 Sugibayashi ..... 365/226
5,463,588 * 10/1995 Chonan ..... 365/226

* cited by examiner

*Primary Examiner*—Terry D. Cunningham
*Assistant Examiner*—Quan Tra
(74) *Attorney, Agent, or Firm*—Stanton C. Braden

(57) ABSTRACT

Apparatus is used to dynamically control the power output of generators of a generator system on a chip to load circuits on the chip. A power bus is directed along at least one "spine" section on the chip which may intersect with at least one "arm" section on the chip for supplying power from the generators, which are coupled to the power bus in the "spine" section thereof, to circuits on the chip. The power bus has a feedback lead from each end which is remote from the generators for providing a continuous measurement of a voltage drop occurring at each remote end. At least one detector circuit is located at a predetermined point adjacent the generators of the chip for comparing a voltage from the generators measured at the predetermined point with the concurrent voltage drop measured at an associated remote end. In response to such comparison, the at least one detector circuit generates control signals for transmission to the generators for altering a generated voltage to maintain a predetermined power level on the power bus in response to load changes caused by the circuits on the chip.

24 Claims, 9 Drawing Sheets

GENERATOR SCHEME AND CIRCUIT FOR OVERCOMING RESISTIVE VOLTAGE DROP ON POWER SUPPLY CIRCUITS ON CHIPS

FIELD OF THE INVENTION

The present invention relates to a generator scheme and circuitry for overcoming resistive voltage drops on power supply lines found on chips without the disadvantage of a general voltage increase such as increased current consumption and reduced reliability of the circuitry.

BACKGROUND OF THE INVENTION

Modem chips such as Dynamic Random Access Memory (DRAM) chips usually comprise several power supply systems, with each supply voltage being regulated to its nominal value. For good circuit performance (e.g., speed), it is desirable to have high voltage levels for these supply voltages for handling variable current loads. However, higher voltage levels also have undesired effects. Current consumption increases, and the potential life span of the circuit decreases. Therefore, a nominal value for each supply voltage has to be a compromise between these conflicting requirements. The generator circuits usually keep their supply voltage at their output close to the nominal value, even under load conditions. However, between the generator and the circuit that is being supplied, a significant voltage drop can occur due to the resistance of the power bus.

Referring now to FIG. 1, there is shown typical block diagram of a prior art exemplary chip 10, such as a VINT generator system of a Dynamic Random Access Memory chip. The chip 10 comprises four areas 12 (shown as dashed line rectangles) adjacent each comer of the chip 10, two horizontal buses in a "spine" section 18 and two vertical buses 14 in an "arm" section 19 which are coupled together at the center of the chip 10, and a plurality of generators or regulators of which an exemplary eight generators 16A–16H are shown. The generators 16A–16H are arbitrary located along the horizontal buses 14 in the "spine" section 18. The buses 14 in the "spine" section 18 and in the "arm" section 19 are coupled to various circuits (not shown) located in the four areas 12 and in the "spine" and "arm" sections. The arrangement of FIG. 1 shows an exemplary DRAM chip 10 where the various circuits in the areas 12 comprise memory circuits (not shown). Due to the fact that all of the generators 16A–16H are located in the "spine" section 18, a stable supply voltage can be guaranteed in the "spine" section 18 under all load conditions. However, certain load conditions (operation modes) of the chip 10 can occur in which a large current is consumed in the "arm" section 19. In this case a significant voltage drop occurs between the "spine" section 18 and circuits supplied in the "arm" section 19.

Referring now to FIG. 2, there is graphically shown exemplary curves of voltage (volts) on the vertical axis versus time in nanoseconds on the horizontal axis, with a first curve 22 representing exemplary measurements that may be found near a central point where the "spine" and "arm" sections 18 and 19 meet near the generators 16C–16F on the prior art chip 10 of FIG. 1, and a second curve 24 representing exemplary measurements that may be found at an end point in the "arm" section 19 of the prior art chip 10 of FIG. 1. A current load (not shown in FIG. 1) that is located at the end of the "arm" section 19 is turned on at a the time of 10 nanoseconds (ns) and turned off at 300 ns in FIG. 2. After an initial voltage drop shown at approximately 35 ns for curve 22, the generator regulates the voltage at its output back to almost its nominal value. At the point of the current load shown by curve 24, the regulated voltage is seen to drop to a value of approximately 100 millivolts (mV) below the nominal value shown in curve 22. Still further, the initial voltage drop in the curve 24 is 100 mV lower than that found at the output of the generator.

Theoretically, it is possible to size the power bus 14 into the "arm" section 19 in a way that the resistive voltage drop is kept at a minimum. However, this results in unfeasible large dimensions for the power bussing of the "arm" section 19. Another theoretical possibility is to place generator or regulator circuits in the "arm" section 19 so that they are closer to the supplied circuits. However, due to space and floor-planning conditions on the chip 10, this is also not feasible. A third possibility is to set the nominal voltage level higher by an amount of the maximum resistive voltage drop found in the "arm" section 19. This, however, would conflict with reliability and current requirements on the chip 10.

It is desirable to provide method and apparatus for a generator system on a chip for overcoming resistive voltage drops on power supply lines by rapidly reacting to increased current consumption while not reducing the reliability of a circuit coupled to the power supply lines without the disadvantages caused by a general voltage increase.

SUMMARY OF THE INVENTION

The present invention is directed to method and apparatus for a generator system on a chip for overcoming resistive voltage drops on power supply lines by rapidly reacting to increased current consumption while not reducing the reliability of a circuit coupled to the power supply lines without the disadvantages caused by a general voltage increase.

Viewed from one aspect, the present invention is directed to apparatus for controlling voltage generators of a generator system on a chip. The apparatus comprises at least one generator, a power bus, and at least one detector circuit. The at least one generator generates a predetermined amount of power to load circuits on the chip. The power bus is directed along at least one first section on the chip for supplying power from the at least one generator to the load circuits on the chip. The power bus comprises a feedback lead from each end of the power bus which is remote from the at least one generator to a predetermined point along the at least one section which is near the at least one generator for providing a continuous measurement of a voltage drop occurring at each remote end of the power bus. The at least one detector circuit is located at the predetermined point of the at least one section near the at least one generator for comparing a voltage from the at least one generator measured at the predetermined point with the voltage drop measured at a remote end of the power bus. In response to such measurements. the at least one detector circuit provides control signals to the at least one generator for altering a generated voltage to maintain a predetermined power level on the power bus in response to load changes caused by the circuits on the chip.

Viewed from another aspect, the present invention is directed to apparatus for controlling voltage generators of a generator system on a chip comprising at least one generator, a power bus, and at least one detector circuit. The at least one generator generates a predetermined amount of power to load circuits on the chip. The power bus is directed along a "spine" section on the chip which intersects with an "arm" section on the chip. The power bus supplies power from the at least one generator, which is coupled to the power bus in the "spine" section thereof, to circuits in adjacent sections of the chip. The power bus comprises a feedback lead from each end of the "arm" section to at least the intersection of the "spine" and "arm" sections for providing a continuous measurement of a voltage drop occurring at each end of the "arm" section. The at least one detector circuit is located adjacent the intersection of the "spine" and "arm" section of the chip for comparing a voltage from the at least one generator measured at the intersection of the "spine" and "arm" sections with the concurrent voltage drop measured at each remote end of the "arm" section. The at least one detector circuit provides BOOST and SPEED control signals to the at least one generator for altering a generated voltage to maintain a predetermined power level on the power bus in response to load changes caused by the circuits in the adjacent sections of the chip.

Viewed from still another aspect, the present invention is directed to apparatus for controlling voltage generators of a generator system on a chip comprising a plurality of generators, a power bus, and first and a second detector circuits. The plurality of generators generate a predetermined amount of power to load circuits on the chip. The power bus is directed along a "spine" section on the chip which intersects with an "arm" section on the chip for supplying power from the plurality of generators, which are coupled via the power bus in the "spine" section thereof, to circuits in adjacent sections of the chip. The power bus comprises a feedback lead from first and second remote ends of the "arm" section to at least the intersection of the "spine" and "arm" sections for providing continuous measurements of a voltage drop occurring at the first and second remote ends of the "arm" section. The first and a second detector circuits are located adjacent to, and on opposite sides of, the intersection of the "spine" and "arm" section of the chip. The first and a second detector circuits compare a voltage from the plurality of generators measured at the intersection of the "spine" and "arm" sections with concurrent voltage drops measured at the first and second remote ends, respectively, of the "arm" section. In turn, the first and second detector circuits provide separate BOOST and SPEED control signals which are logically OR-combined and transmitted to the plurality of generators for altering an overall generated voltage to maintain a predetermined power level on the power bus in the "spine" and "arm" sections in response to load changes caused by the circuits in the adjacent sections of the chip.

Viewed from still another aspect, the present invention is directed to a method for controlling voltage generators of a generator system on a chip. In the method, a predetermined amount of power is generated from at least one generator for transmission along a "spine" section on the chip which intersects with an "arm" section on the chip to load circuits in areas adjacent the "spine" and "arm " sections. Next, a continuous measurement of a voltage drop occurring at each remote end of the "arm" section are obtained via a separate feedback lead to at least the intersection of the "spine" and "arm" sections for providing a continuous measurement of a voltage drop occurring at each end of the "arm" section. Then, a voltage from the at least one generator measured at the intersection of the "spine" and "arm" sections is compared with the concurrent voltage drop measured at the remote end of the "arm" section in at least one detector circuit located adjacent the intersection of the "spine" and "arm" section of the chip for providing BOOST and SPEED control signals to the at least one generator. Finally, a generated voltage from the at least one generator is altered to maintain a predetermined power level on the power bus in response to load changes caused by the circuits in the adjacent sections of the chip.

The invention will be better understood from the following more detailed description taken with the accompanying drawings and claims.

DETAILED DESCRIPTION OF THE INVENTION

Figure 1:
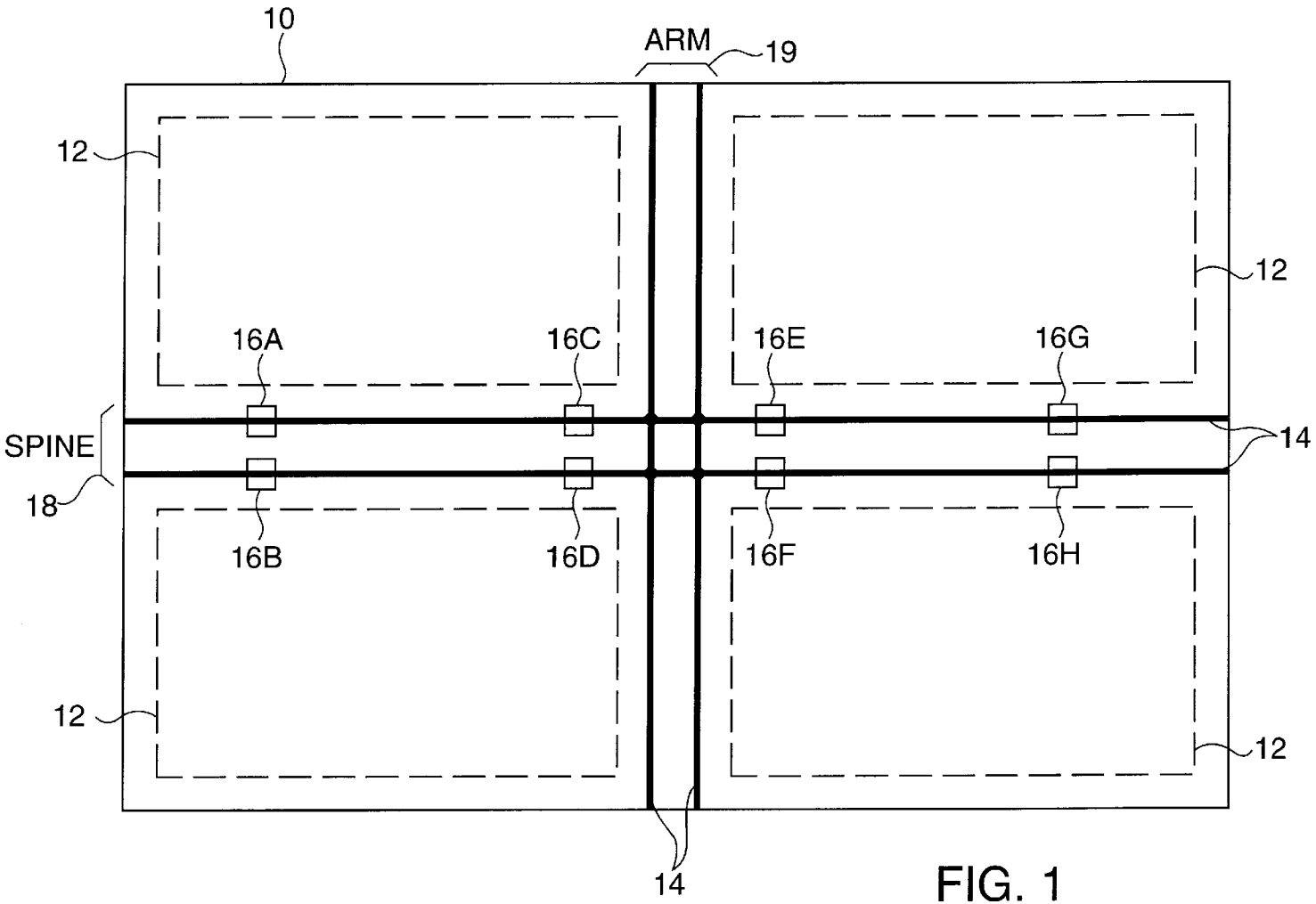
FIG. 1 (PRIOR ART)
FIG. 1 is a typical block diagram of an exemplary prior art chip such as, for example, a VINT generator system of Dynamic Random Access Memory chip.

In accordance with the present invention, the exemplary chip 10 shown in FIG. 1 is modified to permit the sensing of a voltage drop in the "arm" section 19 that is larger than at a generator (also know as a regulator) output (e.g., generator 16E or 16F). It is to be understood hereinafter that the present invention is applicable to chips 10 other than just the exemplary DRAM chip shown in FIG. 1, where there may be one or more "spine" sections 18 and either none or one or more "arm" sections 19 for providing power to circuits (not shown) on the chip 10. The additional possible "spine" and "arm" sections 18 and 19, or the lack of an "arm" section 19, are not shown in FIG. 1 for purposes of simplicity in describing the present invention. If an "arm" section 19 is not provided, it is assumed that the generators are located near one end of the "spine" section and load circuits may be located all along the "spine" section. If such a larger voltage drop is sensed, then the output voltage of the generator is set to a higher level in order to overcome the voltage drop between the generator and the load circuit. Additionally, in order to reduce the initial voltage drop and to speed up the generator reaction, for a short period of time a feedback loop in a generator or regulator is deactivated and the regulator is forced to provide a maximum output current.

Figure 3:
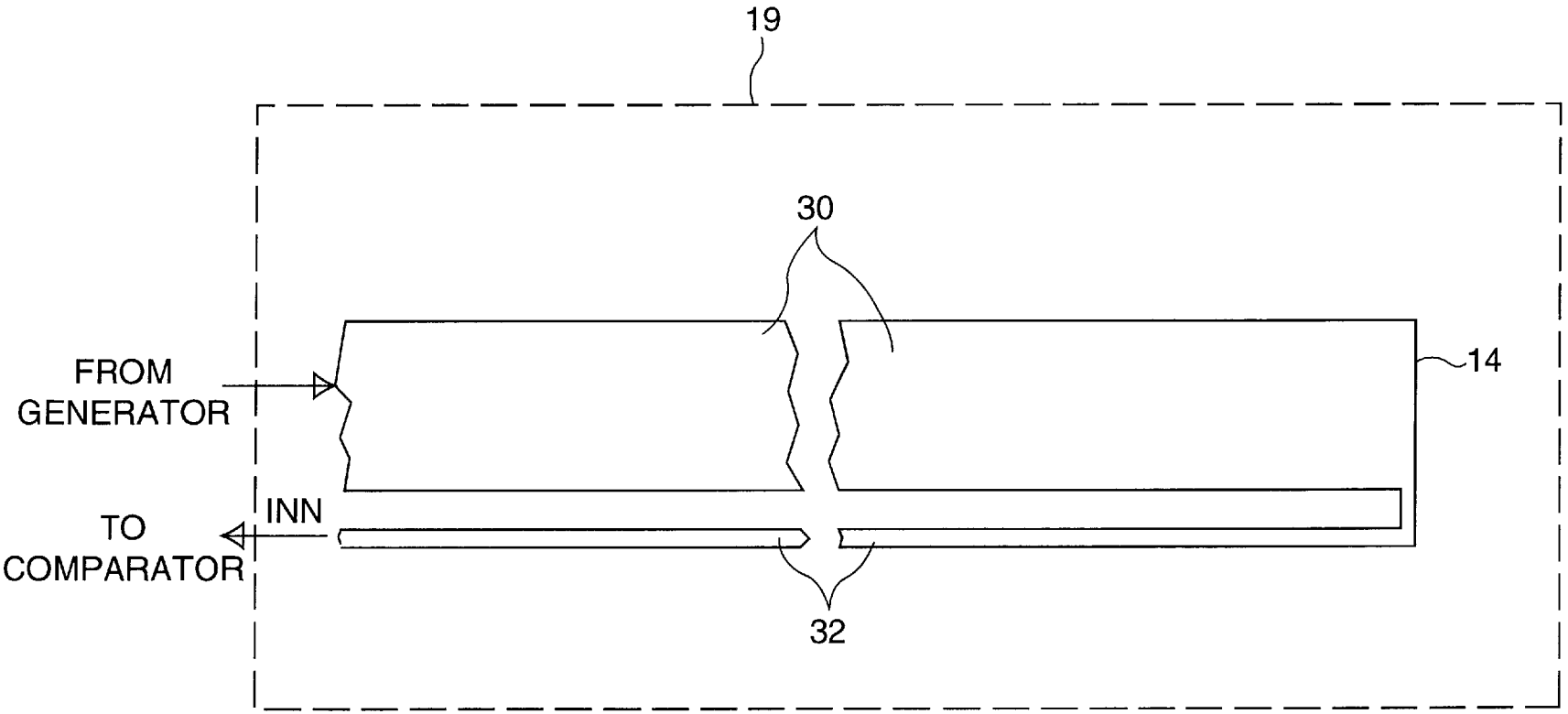
FIG. 3 is a block diagram of a modification of a bus system of an exemplary voltage generator system on the exemplary chip of FIG. 1 for obtaining a voltage measurement at the end of an "arm" portion in accordance with the present invention.

Referring now to FIG. 3, there is shown a block diagram of a modification of each bus 14 of the exemplary voltage generator system on the exemplary chip 10 of FIG. 1 for obtaining a voltage measurement at the end of an "arm" section of FIG. 1 in accordance with the present invention. Each bus in the "arm" section 19 comprises a power supply bus 30 and a signal feedback line 32 which are coupled together at the end of the "arm" section 19. Current is supplied to circuits in the adjacent areas 12 (shown in FIG. 1) from the generators 16A–16H (shown in FIG. 1) via the power supply bus 30, and a signal is connected from the power supply bus 30 back towards the generators 16A-16H via the signal feedback line 32. For exemplary purposes only, the power supply bus 30 can have a width of, for example, thirty pm, and the signal feedback line 32 can have a width of, for example, one pm. Due to the dimensioning of the signal feedback line 32, essentially no current flows through the signal feedback line 32 and, therefore, there is essentially no voltage drop occurs on it The signal feedback line 32 can have a significantly larger resistance than the power supply bus 30, but the resistance-capacitance (RC) delay of the signal feedback line 32 should not be much larger than a reaction time of the associated generator or regulator (not shown) to which it is associated. The voltage (INN) in the signal feedback line 32 is fed back to a comparator 70 (only shown in FIG. 5) as will be described hereinafter with FIG. 5. It is to be understood, that for a chip 10 that only has a "spine" section 18 where the generators 16A–16H are located in one area of the "spine" section 18, the feedback line 32 would be found returning from an end of the power bus 14 that is remote from the generators 16A–16H.

Figure 4:
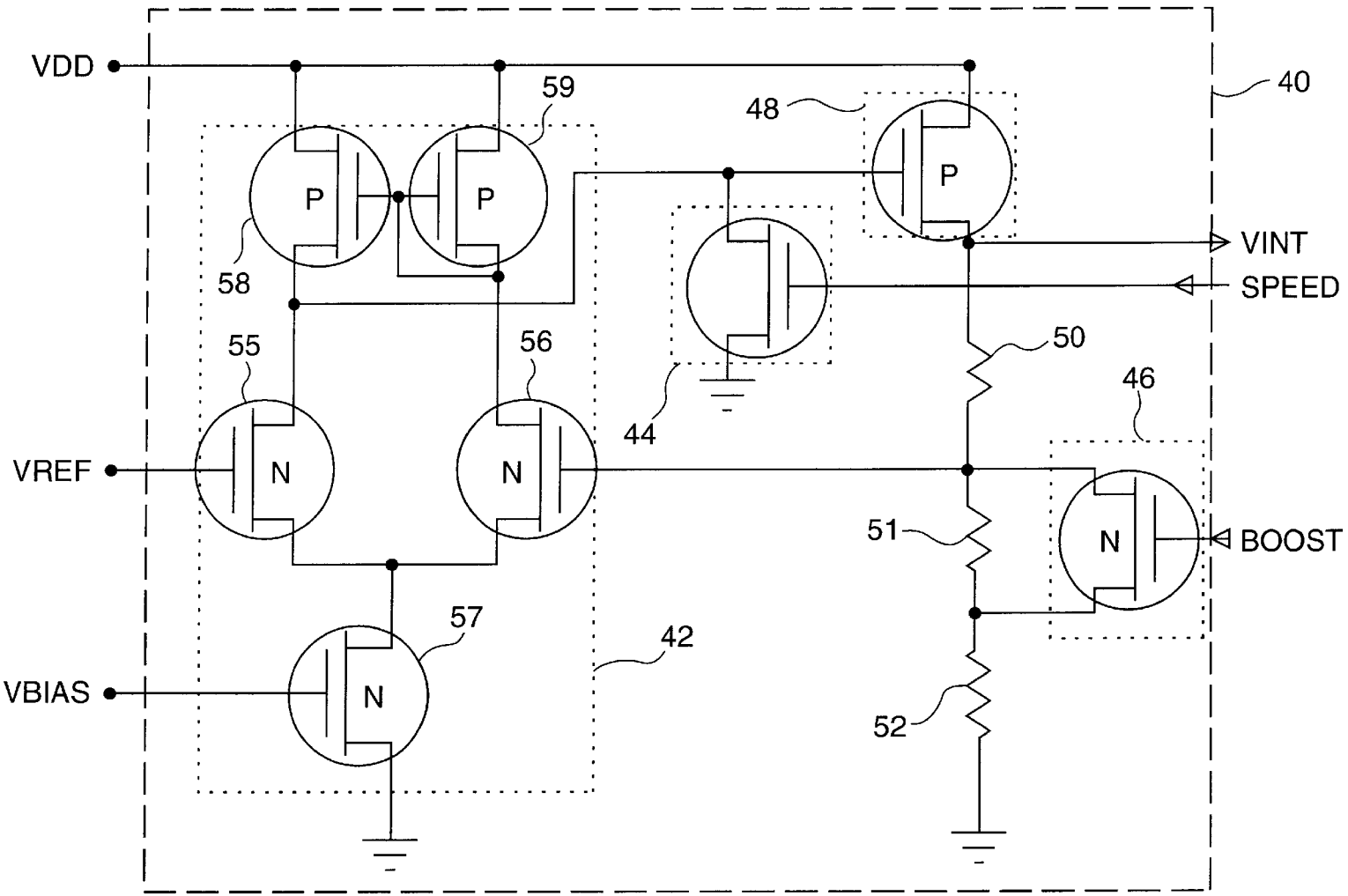
FIG. 4 shows an exemplary circuit diagram of a novel regulator or generator circuit for use in as the generators on the chip of FIG. 1 in accordance with the present invention.

Referring now to FIG. 4, there is shown an exemplary circuit diagram of a novel regulator or generator circuit 40 (shown within a dashed line rectangle) for use in the place of each of the generators 16A–16H on the chip of FIG. 1 in accordance with the present invention. The regulator or generator circuit 40 comprises a differential amplifier 42 (shown within a dashed line rectangle), first and second N-channel Field Effect Transistors (FETS) 44 and 46 (each shown within a separate dashed line rectangle), a P-channel Field Effect Transistor (FET) 48 (shown within a dashed line rectangle), and first, second, and third resistors 50, 51, and 52. The differential amplifier 42 comprises first, second, and third N-channel FETs 55, 56, and 57, and first and second P-channel FETs 58 and 59. The arrangement and interconnections of the FETs of the differential amplifier 42 are a well known arrangement for a differential amplifier. With reference to the FETs 58 and 59, the source electrodes of the FETs 58 and 59 are coupled to a supply voltage VDD, the gate electrodes of the FETs 58 and 59 are coupled together and to a drain electrode of the FET 59, and to a drain electrode of the FET 56. The drain electrode of the FET 58 is coupled to a drain electrode of the FET 55. The gate electrode of the FET 55 is coupled to receive a reference voltage (VREF). The source electrodes of the FETs 55 and 56 are coupled together and to a drain electrode of the FET 57. The gate electrode of the FET 57 is coupled to receive a bias voltage (VBIAS), and the source electrode of the FET 57 is coupled to a reference potential which is illustratively shown as ground potential.

The FET 48 of the regulator 40 has a source electrode coupled to the supply voltage VDD, and its gate electrode coupled to the drain electrode of the FET 44 of the regulator 40 and to the drain electrodes of the FETs 55 and 58 in the differential amplifier 42. The drain electrode of the FET 48 of the regulator is coupled to a first terminal of the first resistor 50, and provides an output voltage VINT from the regulator 40. A second terminal of the resistor 50 is coupled to in interconnection between each of a drain electrode of the FET 46 of the regulator 40, a first terminal of the resistor 51, and a gate electrode of the FET 56 in the differential amplifier 42. A second terminal of the resistor 51 is coupled to a source electrode of the FET 46 of the regulator 40 and to a first terminal of the resistor 52. A second terminal of the resistor 52 is coupled to a reference potential which is shown as ground potential A gate electrode of the FET 44 of the regulator 42 is coupled to receive an externally generated SPEED signal, while its source electrode is coupled to a reference potential which is shown as ground potential. The gate electrode of the FET 46 of the regulator 40 is coupled to receive an externally produced BOOST signal.

In operation, the differential amplifier 42 compares the reference voltage (VREF) to the voltage VINT that is fed back via a feedback path through the resistor 50 to the gate electrode of the FET 56 of the differential amplifier 42. If the voltage VINT is low, then the feedback voltage to the gate electrode of the FET 56 of the differential amplifier 42 is also low as determined by the comparison made with the voltage VREF. As a response, the differential amplifier 42 reduces the voltage to the gate electrode of the FET 48 of the regulator 40 via the path from the interconnection of the source electrode of the FET 55 and the drain electrode of the FET 58 of the differential amplifier 42 This causes more current to flow from the voltage source VDD to the output node for the voltage VINT. In turn, this increases the voltage VINT and also the feedback voltage to the gate electrode of the FET 56 of the differential amplifier 42 via the path through the first resistor 50. This forms a control loop that keeps the output voltage VINT at a stable level, where the level is determined by the reference voltage VREF. In reality, the output level of VINT is not ideally stable, because the regulator 40 has a limited response speed. If a current is suddenly drawn from the output voltage VINT by a remote coupled circuit (not shown) it will bring the output voltage VINT down, and it takes the regulator 40 a short time to respond.

Figure 5:
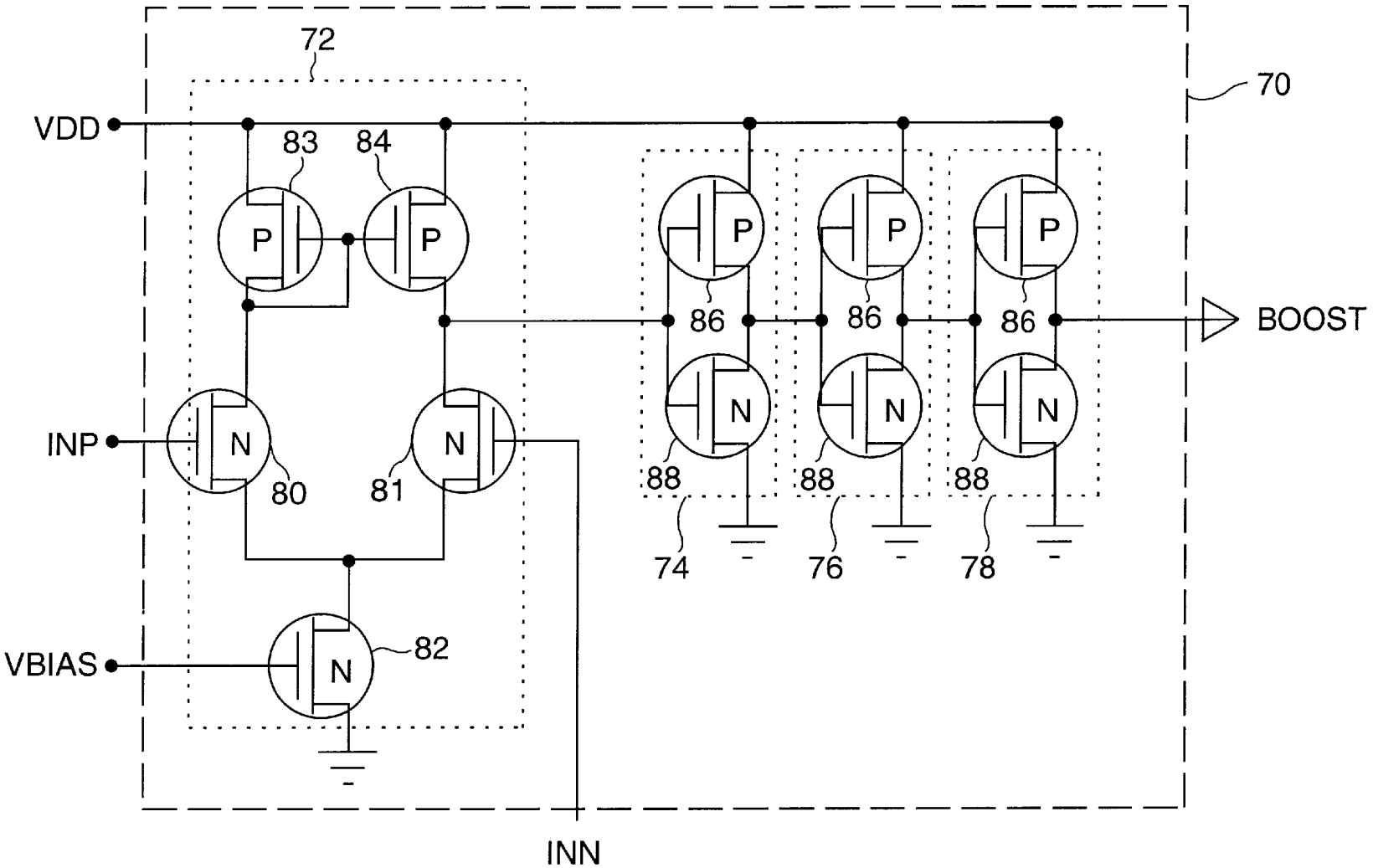
FIG. 5 shows an exemplary circuit diagram of a novel comparator for use on the chip of FIG. 1 in accordance with the present invention.

Referring now to FIG. 5, there is shown an exemplary circuit diagram of a novel comparator 70 for use in producing a BOOST signal that is used by the regulator 40 of FIG. 4 in accordance with the present invention. The comparator 70 comprises a differential amplifier 72 (shown within a dashed line rectangle), and first, second, and third amplifier circuits 74, 76, and 78 (shown within dashed line rectangles) which are all coupled in parallel between a supply voltage VDD and a reference voltage shown as ground potential.

The differential amplifier 72 comprises first, second, and third N-channel FETs 80, 81, and 82, and first and second P-channel FETs 83 and 84. The arrangement and interconnections of the FETs 80, 81, 82, 83, and 84 are a well known arrangement for a differential amplifier. A source electrode of each of the FETs 83 and 84 are coupled to a supply voltage VDD. Gate electrodes of the FETs 83 and 84 are coupled together and to a drain electrodes of the FETs 80 and 83. A drain electrode of the FET 84 is coupled to a drain electrode of the FET 81. A gate electrode of the FET 80 is coupled to receive a voltage INP measured adjacent the generators at an intersection of the "spine" and "arm" sections shown in FIG. 1, while the gate electrode of the FET 81 is coupled to receive a voltage INN measured at a far end of an "Arm" section 19 shown in FIG. 1 that is obtained via a signal feedback line 32 shown in FIG. 3. Source electrodes of the FETs 80 and 81 are coupled together and to a drain electrode of the FET 82. A gate electrode of the FET 82 is coupled to receive a bias voltage (VBIAS), and a source electrode of the FET 82 is coupled to a reference potential which is shown as ground potential.

Each of the amplifiers 74, 76, and 78 comprises a P-channel FET 86 and an N-channel FET 88. In each of the amplifiers 74, 76, and 78, the FET 86 has a source electrode which is coupled to the supply voltage VDD, a drain electrode which is coupled to a drain electrode of the FET 88, and a gate electrode which is coupled to a gate electrode of FET 88. The source of FET 88 is coupled to a reference potential shown as a ground potential. The coupled gate electrodes of the FETs 86 and 88 of the first amplifier 74 are coupled to the drain electrodes of the FETs 84 and 81 of the differential amplifier 72. The coupled gate electrodes of the FETs 86 and 88 of the second amplifier 76 are coupled to the drain electrodes of the FETs 86 and 88 of the first amplifier 74. The coupled gate electrodes of the FETS 86 and 88 of the third amplifier 78 are coupled to the coupling of the drain electrodes of the FETS 86 and 88 of the second amplifier 76. The coupling of the drain electrodes of the FETs 86 and 88 of the third amplifier 78 provide an output BOOST signal which is transmitted to the generator or regulator 40 shown in FIG. 4.

In operation, The differential amplifier 72 compares the voltage level INP measured near the generator or regulator 40 with the voltage level INN measured at the far end of the "Arm" section 19 as shown in FIG. 3. The results of such comparison is an output signal that is transmitted to the gate electrodes of the FETs 86 and 88 of the first amplifier 74. The slope of this output signal is not very steep, and the first amplifier functions to generate an output signal to the gate electrodes of the FETs 86 and 88 of the second amplifier 76 with an increased slope. Similarly, the second amplifier is responsive to the output signal from the first amplifier 74 to generate an output signal to the gate electrodes of the FETs 86 and 88 of the third amplifier 78 where the slope is further increased. The third amplifier 78 is responsive to the output signal from the second amplifier 76 to generate a BOOST output signal from the comparator 70 where the slope is still further increased to a predetermined slope. The BOOST signal is transmitted to the generator or regulator 40 shown in FIG. 4, and to a SPEED signal generating circuit as is described hereinafter and shown in FIG. 6.

Figure 6:
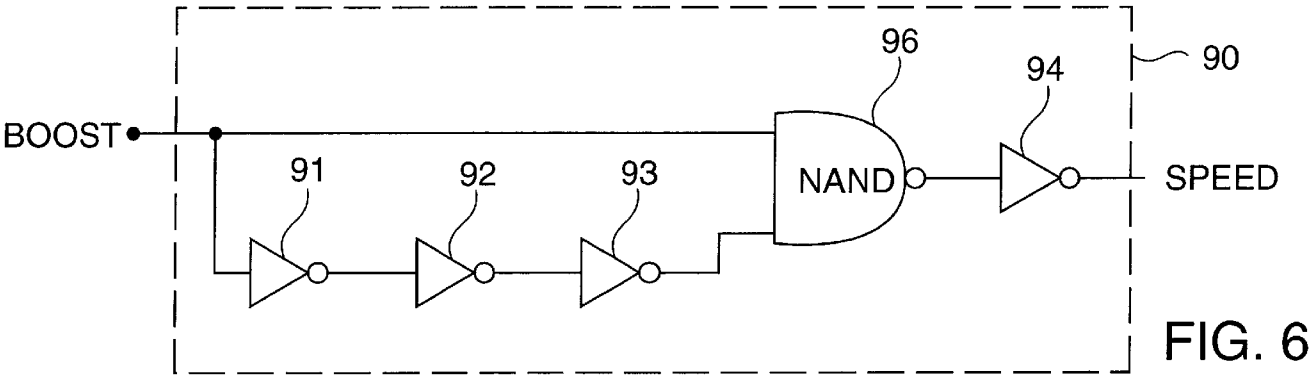
FIG. 6 shows a block diagram of a SPEED signal generating circuit in accordance with the present invention.

Referring now to FIG. 6, there is shown a SPEED signal generating circuit 90 in accordance with the present invention which is preferably located adjacent the comparator circuit of FIG. 5. The SPEED signal generating circuit 90 comprises first, second, third, and fourth inverters 91, 92, 93, and 94, and a NAND gate 96. A BOOST signal from the comparator 70 of FIG. 5 is coupled to a first input of the NAND gate 96 and to an input of the first inverter 91. The first, second, and third inverters 91, 92, and 93 are coupled in series and to a second input of the NAND gate 96 to provide a predetermined delay of the received BOOST signal. An output of the NAND circuit 96 is coupled to an input of the fourth inverter 94 whose output generates the SPEED output signal which is transmitted to the generator or regulator 40 of FIG. 4. The functioning of the SPEED signal generating circuit 90 is illustrated in FIG. 7.

Figure 7:
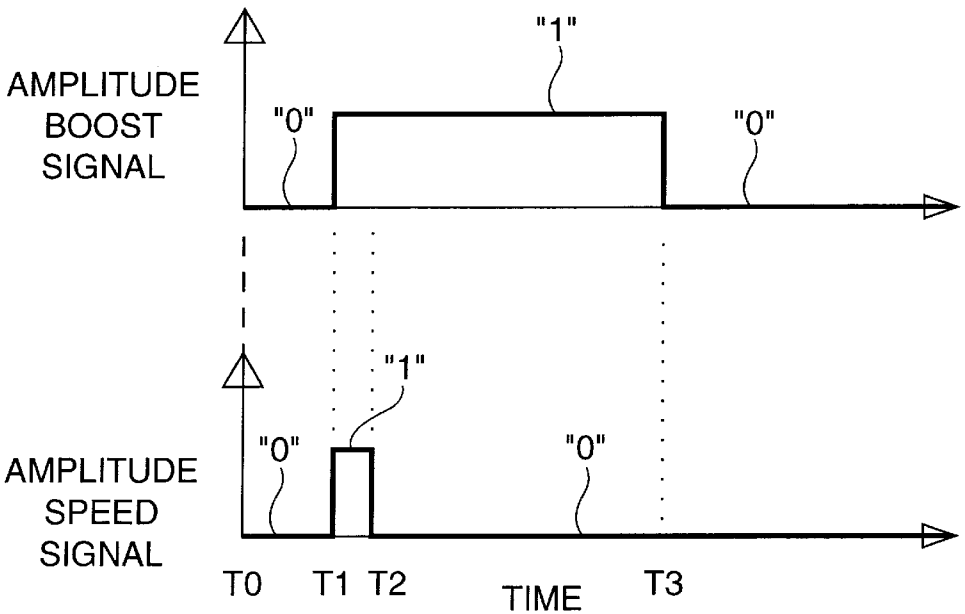
FIG. 7 graphically shows exemplary curves of amplitude versus time in nanoseconds of both a BOOST signal generated by the comparator of FIG. 5 and a SPEED signal produced by the SPEED signal generating circuit of FIG. 6 in accordance with the present invention.

Referring now to FIG. 7, there is graphically shown exemplary curves of amplitude along the vertical axis versus time along the horizontal axis of a BOOST signal generated by the comparator of FIG. 5, and a SPEED signal produced by the SPEED signal generating circuit of FIG. 6. At time TO, the BOOST signal has a logical "0" value, and a logical "0" occurs at the first input of the NAND gate 96 while the first, second, and third inverters 91, 92, and 93 cause a logical "1" to be placed on the second input of the NAND gate 96. This results in logical "1" out put signal from the NAND gate 96 which is converted to a logical "0" SPEED output signal by the fourth inverter 94. At time T1, the BOOST signal goes to a logical "1" value which is placed on the first input of the NAND gate 96. However, due to a slight delay in the reaction time of the first, second, and third inverters 91, 92, and 93, the original logical "1" signal temporarily remains at the second input to the NAND gate 96. This results in a logical "0" output signal from the NAND gate 96 which is converted to a logical "1" SPEED output signal by the fourth inverter 94. At time T2, the BOOST signal is still at logical "1" value and the reaction time of the first, second, and third inverters 91, 92, and 93 now causes a logical "0" signal to be placed on the second input of the NAND gate 96. This results in a logical "1" output signal from the NAND gate 96 which is converted into a logical "0" SPEED output signal by the fourth inverter 94. At time T3 the BOOST signal returns to a logical "0" and the circuit 90 of FIG. 6 returns to the start position found at time T0. Therefore, the delay provided by the first, second, and third inverters 91, 92, and 93 determine the width of the SPEED pulse once the BOOST signal goes to a logical "1" .

Figure 8:
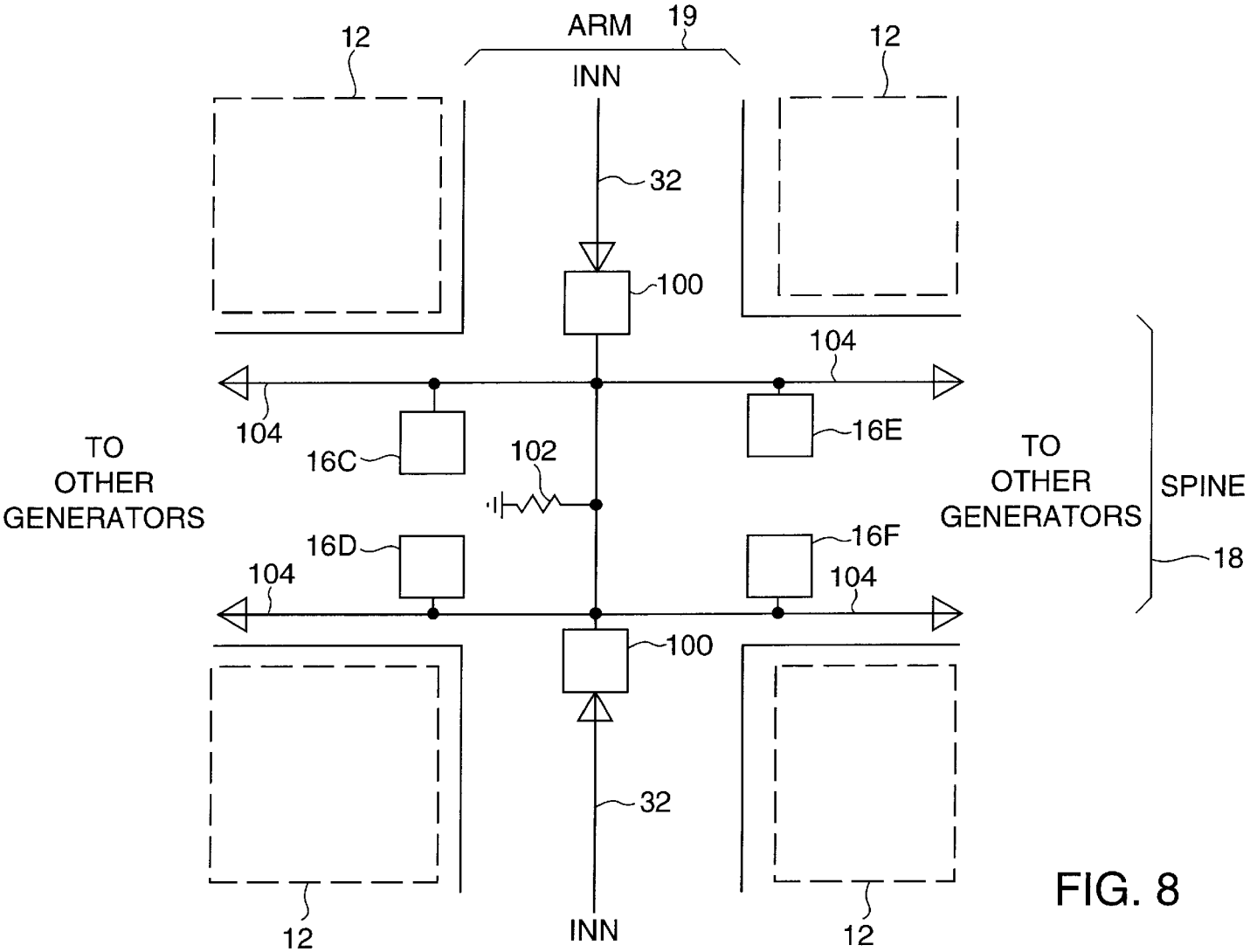
FIG. 8 shows an expanded view of a central section of the chip of FIG. 1 as modified in accordance with the present invention.

Referring now to FIG. 8, there is shown an expanded view of a central section of the chip 10 of FIG. 1 where the "Arm" section 19 and the "Spine" section 18 intersect as modified in accordance with the present invention. In the "Spine" sections adjacent the intersection, the generators or regulators 16C, 16D, 16E, and 16F of FIG. 1 are shown. What is not shown are the power supply busses 14 of FIG. 1 which supply power from the generators 16C, 16D, 16E, and 16F (and the generators 16A, 16B, 16G, and 16H shown in FIG. 1) to the circuits located in the four areas 12. In each "Arm" section 19, a detector circuit 100 is located, for example, where the "Arm" section 19 meets the "Spine" section 18. Each detector circuit 100 comprises a comparator circuit 70 shown in FIG. 5 for generating a BOOST output signal, and a SPEED signal generating circuit 90 shown in FIG. 6 which generates the SPEED output signal from the BOOST signal. The two detector circuits 100 are logically OR combined by a wired-OR connection including a resistor 102 coupled to ground potential. The BOOST and SPEED signals generated by the detector circuits 100, once OR-combined, are transmitted to each of the generator or regulators 16A–16H via the signal busses 104. The generator or regulators 16A–16H use the BOOST and SPEED signals as described hereinbefore for the circuitry 40 of FIG. 4.

Figure 2:
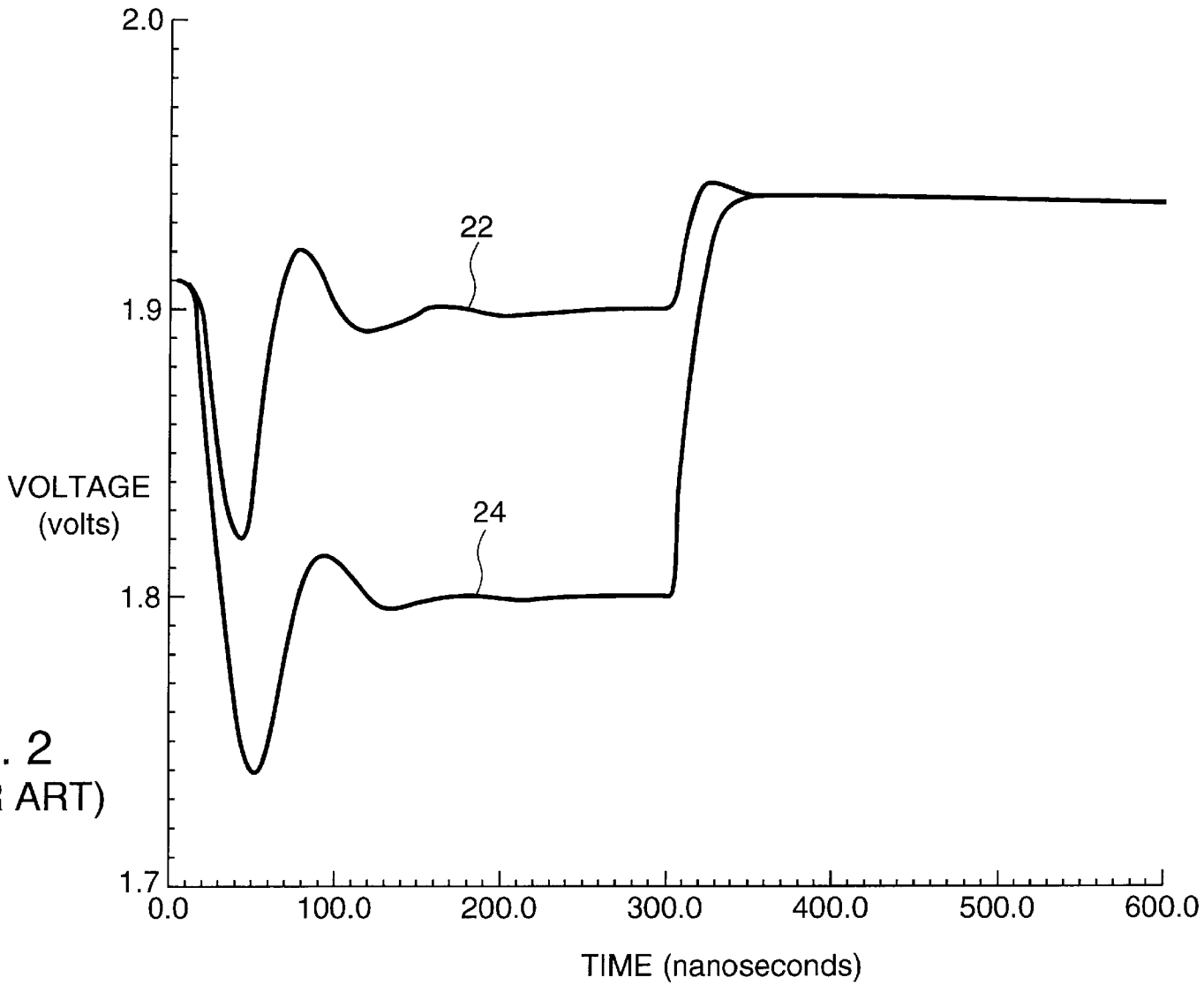
FIG. 2 (PRIOR ART)
FIG. 2 graphically shows exemplary curves of voltage versus time in nanoseconds at a central point on the prior art chip of FIG. 1, and at a remote point in an "arm" portion of the prior art chip of FIG. 1.
Figure 9:
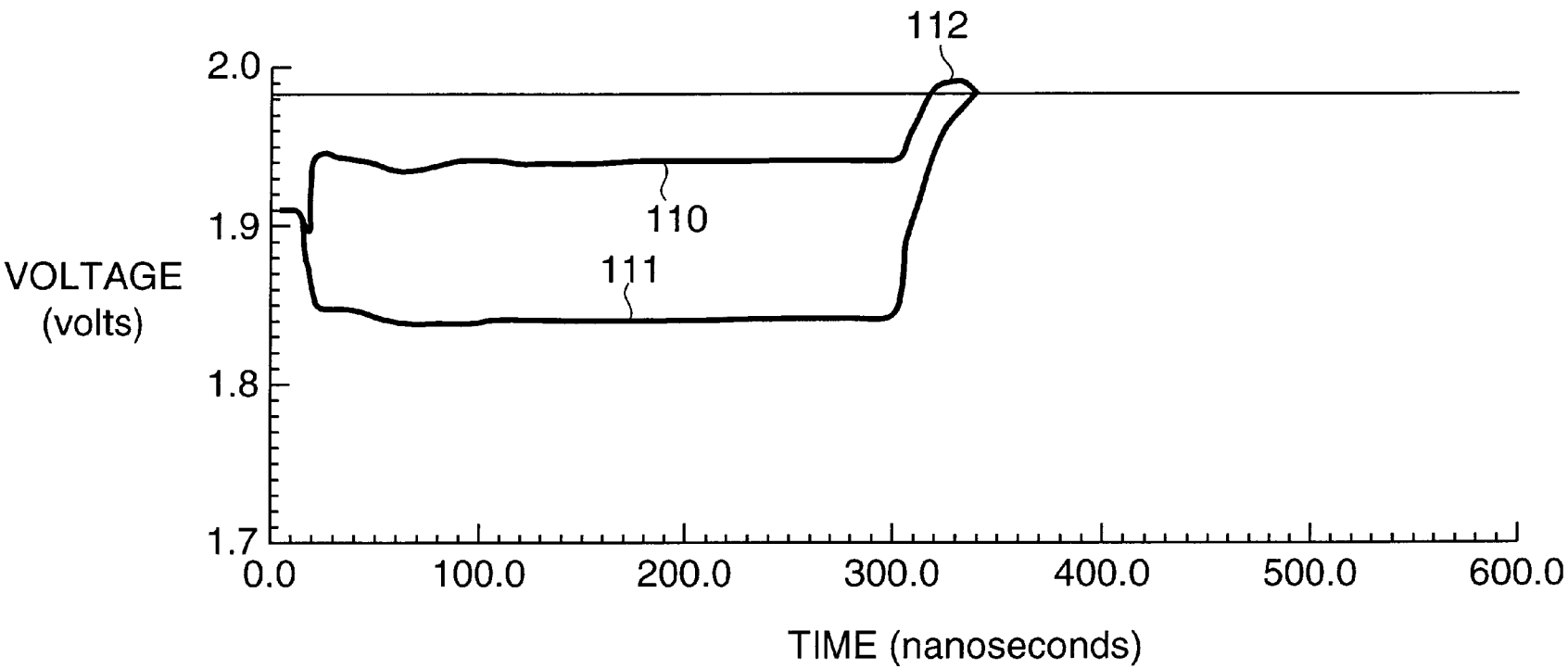
FIG. 9 graphically shows exemplary curves of voltage on the vertical axis versus time in nanoseconds on the horizontal axis as may be obtained for a chip comprising the arrangement shown in FIG. 8 in accordance with the present invention.

Referring now to FIG. 9, there is graphically shown exemplary curves 110 and 111 of voltage in volts on the vertical axis versus time in nanoseconds on the horizontal axis as may be obtained for a chip 10 comprising the arrangement shown in FIG. 8 in accordance with the present invention. The first curve 110 represents exemplary measurements that may be found near a central point where the "spine" and "arm" sections 18 and 19 meet on the prior art chip 10 of FIG. 1 near generators 16C–16F when using the arrangements of FIGS. 3–6 and 8 in accordance with the present invention. The second curve 111 represents exemplary measurements that may be found at an end point of the "arm" section 19 when using the arrangements of FIGS. 3–6 and 8 in accordance with the present invention. The curves 110 and 111 can be compared to corresponding curves 22 and 24 in FIG. 2 for a prior art chip 10 which does not use the arrangements of FIGS. 3–6 and 8. When comparing the curves 22 and 24 of FIGS. 2 with the curves 110 and 111, respectively, of FIG. 9, it is apparent that the lowest voltage drop is reduced from 170 mv (in FIG., 2) to 70 mv (in FIG. 9) when using the arrangements of FIGS. 3–6 and 8. The final overshoot 112 that occurs at the end of the generator activation period is slightly larger than found in FIG. 2. However, under normal operating conditions, this overshoot 112 can be reduced by using circuits that use the voltage VINT as a voltage supply.

Figure 10:
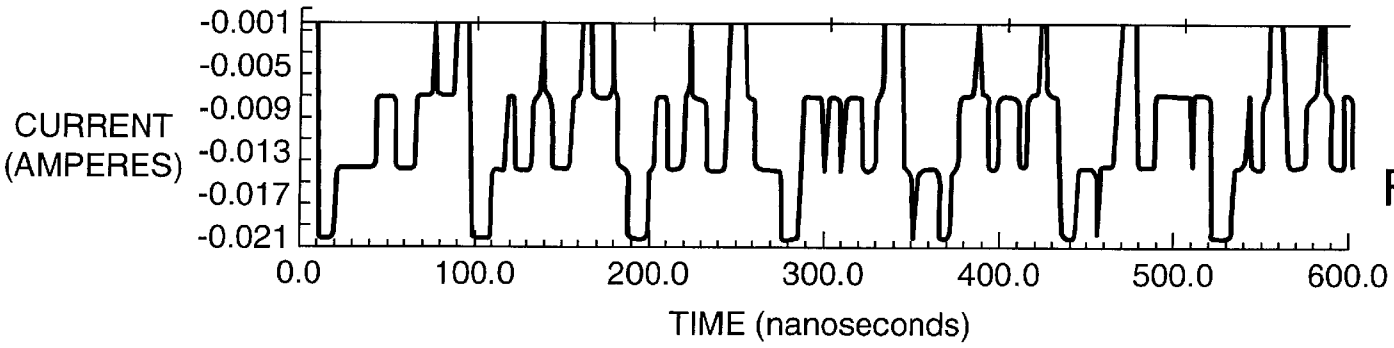
FIG. 10 graphically shows an exemplary curve of amperes on the vertical axis versus time in nanoseconds on the horizontal axis for load current as may be found in the chip of FIGS. 1 and 9 that is supplied to circuitry in areas adjacent the "spine" section and "arm" section of the chip.
Figure 11:
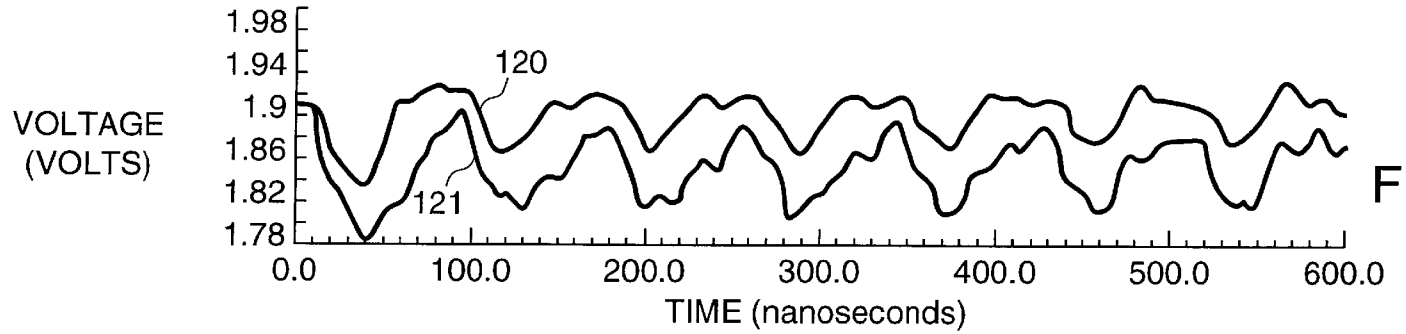
FIG. 11 graphically shows exemplary curves of Volts on the vertical axis versus time in nanoseconds on the horizontal axis as might be found in the prior art chip of FIG. 1 not using the arrangements of FIGS. 3–6 and 8.
Figure 12:
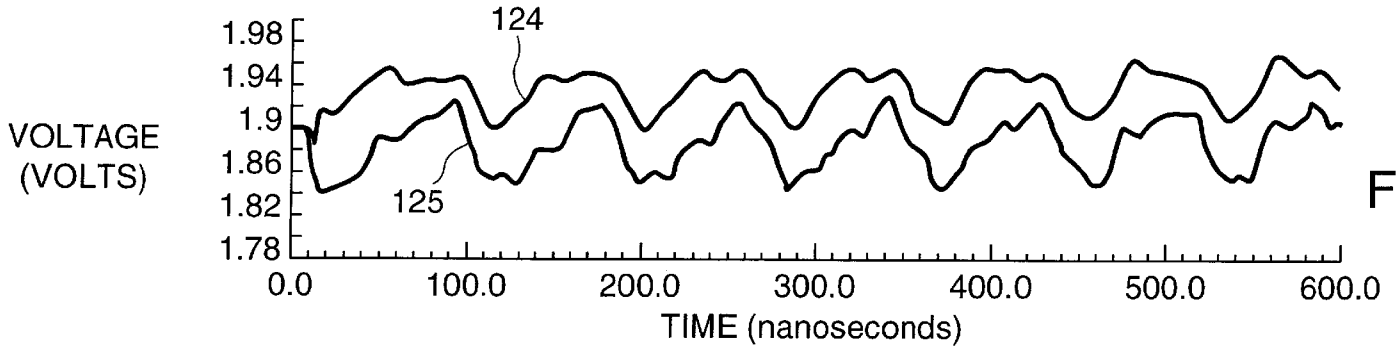
FIG. 12 graphically shows exemplary curves of Volts on the vertical axis versus time in nanoseconds on the horizontal axis as might be found in the chip of FIG. 1 using the arrangements of FIGS. 3–6 and 8 in accordance with the present invention.

Referring now to FIGS. 10, 11, and 12, there is graphically shown exemplary curves for different load conditions on the chip 10 of FIGS. 1 and 9. FIG. 10 graphically shows an exemplary curve of current (amperes) on the vertical axis versus time in nanoseconds on the horizontal axis for load current in FIGS. 1 and 9 supplied to circuitry in areas 12 adjacent the "spine" section 18 and "arm" section 19. FIG. 11 graphically shows exemplary curves 120 and 121 of Voltage (Volts) on the vertical axis versus time in nanoseconds on the horizontal axis as might be found in the prior art chip 10 of FIG. 1 not using the arrangements of FIGS. 3–6 and 8 for the load conditions of FIG. 10. The curve 120 represents exemplary measurements that may be found near a central point where the "spine" and "arm" sections 18 and 19 meet on the prior art chip 10 of FIG. 1 near generators 16C–16F. The curve 121 represents exemplary measurements that may be found at an end point of the "arm" section 19 when the arrangements of FIGS. 3–6 and 8 are not used. FIG. 12 graphically shows exemplary curves 124 and 125 of Voltage (Volts) on the vertical axis versus time in nanoseconds on the horizontal axis as might be found in the chip of FIG. 1 using the arrangements of FIGS. 3–6 and 8 for the load conditions of FIG. 10 in accordance with the present invention. The curve 124 represents exemplary measurements that may be found near a central point where the "spine" and "arm" sections 18 and 19 meet on a chip 10 of FIG. 1 near generators 16C–16F when using the arrangements of FIGS. 3–6 and 8. The curve 125 represents exemplary measurements that may be found at an end point of the "arm" section 19 when using the arrangements of FIGS. 3–6 and 8.

In FIG. 10 the load current varies rapidly, and the reaction times for the generators or regulators 16A–16H of FIGS. 1 and 8 for such load current variations are shown in FIGS. 11 and 12. When comparing the corresponding curves 120 and 121 of FIG. 11 and the corresponding curves 124 and 125, respectively, of FIG. 12, a maximum voltage drop of 60 mV is obtained in FIG. 12 when using the arrangements of FIGS. 3–6 and 8 in accordance with the present invention which is less than that found when not using the arrangements of FIGS. 3–6 and 8.

Usually more than one generator or regulator 16A–16H is active. For example, all eight generators 16A–16H are usually active at the same time. Under such case, it has to be ensured that when a BOOST condition occurs, all of the generators 16A–16H receive the respective BOOST and SPEED signals generated by the comparator 70 and the SPEED signal generating circuit 90 shown in FIGS. 5 and 6, respectively. if only one of the generators 16A–16H were to receive the BOOST and SPEED signals, then only that generator (e.g., generator 16A) would try to raise the voltage level, and the other generators (e.g., generators 16B–16H) would not support this action. As a result, the single generator (e.g., generator 16A) would usually not be able to generate the required current, and the overall voltage level would not be boosted up to the intended level.

The present invention provides the advantages of overcoming resistive voltage drops on power supply lines by a fast boosting of the output voltage of generators of a generator system on, for example, a chip. Since the boosting operation is only performed if the voltage drop occurs, this is not equivalent to a general increase of the supply voltage, and thus avoids the disadvantages of a general voltage increase (involving increased current consumption and reduced reliability of a load circuit).

It is to be appreciated and understood that the specific embodiments of the present invention described hereinabove are merely illustrative of the general principles of the invention. Various modifications may be made by those skilled in the art which are consistent with the principles set forth.

What is claimed is:

1. Apparatus for controlling voltage generators of a generator system on a chip comprising:

at least one generator for generating a predetermined amount of power to load circuits on the chip;

a power bus directed along at least one first section on the chip for supplying power from the at least one generator to the load circuits on the chip, the power bus comprising a feedback lead from each end of the power bus which is remote from the at least one generator to a predetermined point of the at least one section which is near the at least one generator for providing a continuous measurement of a voltage drop occurring at each remote end of the power bus; and at least one detector circuit located at the predetermined point of the at least one section near the at least one generator for comparing a voltage from the at least one generator measured at the predetermined point with the voltage drop measured at a remote end of the power bus for providing control signals to the at least one generator for altering a generated voltage to maintain a predetermined power level on the power bus in response to load changes caused by the circuits on the chip.

2. The apparatus of claim 1 wherein each detector circuit comprises:

a comparison arrangement for comparing a voltage of the at least one generator measured at the predetermined point near the at least one generator with a voltage measured at each remote end of the power bus for generating a BOOST signal to the at least one generator representing a voltage difference between the two measured voltages for altering the generated voltage to maintain the predetermined power level on the power bus.

3. The apparatus of claim 2 wherein each detector circuit further comprises:

at least one amplifying arrangement, wherein each amplifying arrangement increases a slope of the BOOST signal generated by the comparison arrangement and any prior amplifying arrangement prior to the BOOST signal being transmitted to the at least one generator.

4. The apparatus of claim 2 wherein each detector circuit further comprises:

a SPEED signal generating circuit comprising:

a NAND gate comprising a first input for receiving the BOOST signal from the comparison arrangement, a second input, and an output;

a delay circuit for introducing a predetermined delay into the BOOST signal received from the comparison arrangement for transmission to the second input of the NAND gate; and an inverter responsive to a logical output signal from the output of the NAND gate for generating a SPEED output control signal from the SPEED signal generating circuit for transmission to the at least one generator for altering the generated voltage to maintain the predetermined power level on the power bus.

5. The apparatus of claim 2 wherein each generator comprises:

a comparison circuit for comparing a reference voltage with an output voltage of the generator, and generating a output control signal when a voltage drop above a predetermined value is detected in the output voltage of the generator; and a P-channel Field Effect Transistor which is responsive to the control output signal from the comparison circuit for increasing the output voltage of the generator to the power bus to compensate for the voltage drop.

6. The apparatus of claim 5 where each generator further comprises:

a first N-channel Field Effect Transistor which is responsive to the BOOST signal generated by the detector circuit indicating that a voltage drop is detected for generating a feedback signal to the comparison circuit and causing the comparison circuit to generate the output control signal to the P-channel Field Effect Transistor to compensate for the voltage drop; and a second N-channel Field Effect Transistor which is responsive to an externally generated SPEED control signal for generating a feedback signal to the comparison circuit for causing the generator to generate a predetermined maximum output current to the power bus.

7. Apparatus for controlling voltage generators of a generator system on a chip comprising:

at least one generator for generating a predetermined amount of power to load circuits on the chip;

a power bus directed along a "spine" section on the chip which intersects with an "arm" section on the chip for supplying power from the at least one generator to circuits in adjacent sections of the chip, the bus comprising a feedback lead from each remote end of the "arm" section to at least the intersection of the "spine" and "arm" sections for providing a continuous measurement of a voltage drop occurring at each remote end of the "arm" section; and at least one detector circuit located adjacent the intersection of the "spine" and "arm" sections of the chip for comparing a voltage from the at least one generator measured at the intersection of the "spine" and "arm" sections with the voltage drop measured at each end of the "arm" section for providing control signals to the at least one generator for altering a generated voltage to maintain a predetermined power level on the power bus in response to load changes caused by the circuits in the adjacent sections of the chip.

8. The apparatus of claim 7 wherein each detector circuit comprises:

a comparison arrangement for comparing a voltage of the at least one generator measured at the intersection of the "arm" and "spine" with a voltage measured at each end of the "arm" section for generating a BOOST signal to the at least one generator representing a voltage difference between the two measured voltages for altering the generated voltage to maintain the predetermined power level on the power bus.

9. The apparatus of claim 8 wherein each detector circuit further comprises:

at least one amplifying arrangement, wherein each amplifying arrangement increases a slope of the BOOST signal generated by the comparison arrangement and any prior amplifying arrangement prior to the BOOST signal being transmitted to the at least one generator.

10. The apparatus of claim 8 wherein each detector circuit further comprises:

a SPEED signal generating circuit comprising:

a NAND gate comprising a first input for receiving the BOOST signal from the comparison arrangement, a second input, and an output;

a delay circuit for introducing a predetermined delay into the BOOST signal received from the comparison arrangement for transmission to the second input of the NAND gate; and an inverter responsive to a logical output signal from the output of the NAND gate for generating a SPEED output control signal from the SPEED signal generating circuit for transmission to the at least one generator for altering the generated voltage to maintain the predetermined power level on the power bus.

11. The apparatus of claim 8 wherein each generator comprises:

a comparison circuit for comparing a reference voltage with an output voltage of the generator, and generating a output control signal when a voltage drop above a predetermined value is detected in the output voltage of the generator; and a P-channel Field Effect Transistor which is responsive to the control output signal from the comparison circuit for increasing the output voltage of the generator to the power bus to compensate for the voltage drop.

12. The apparatus of claim 11 where each generator further comprises:

a first N-channel Field Effect Transistor which is responsive to the BOOST signal generated by the detector circuit indicating that a voltage drop is detected for generating a feedback signal to the comparison circuit and causing the comparison circuit to generate the output control signal to the P-channel Field Effect Transistor to compensate for the voltage drop; and a second N-channel Field Effect Transistor which is responsive to an externally generated SPEED control signal for generating a feedback signal to the comparison circuit for causing the generator to generate a predetermined maximum output current to the power bus.

13. Apparatus for controlling voltage generators of a generator system on a chip comprising:

a plurality of generators for generating a predetermined amount of power to load circuits on the chip;

a power bus directed along a "spine" section on the chip which intersects with an "arm" section on the chip for supplying power from the plurality of generators which are coupled via the power bus in the "spine" section thereof to circuits in adjacent sections of the chip, the bus comprising a feedback lead from the first and second remote ends of the power bus in the "arm" section to at least the intersection of the "spine" and "arm" sections for providing continuous measurements of a voltage drop occurring at the first and second remote ends of the "arm" section; and a first and a second detector circuit located adjacent the intersection of the "spine" and "arm" section of the chip on opposite sides of the intersection for comparing a voltage from the plurality of generators measured at the intersection of the "spine" and "arm" sections with the concurrent voltage drops measured at the first and second remote ends, respectively, of separate sections of the "arm" section for providing separate BOOST and SPEED control signals which are logically OR-combined and transmitted to the plurality of generators for altering an overall generated voltage to maintain a predetermined power level on the power bus in the "spine" and "arm" sections in response to load changes caused by the circuits in the adjacent sections of the chip.

14. The apparatus of claim 13 wherein each detector circuit comprises:

a comparison arrangement for comparing a voltage of the plurality of generators measured at the intersection of the "arm" and "spine" with a voltage measured at an associated on of the first and second remote ends of the "arm" section for generating a BOOST signal to the plurality of generators representing a voltage difference between the two measured voltages.

15. The apparatus of claim 14 wherein each detector circuit further comprises:

at least one amplifying arrangement, wherein each amplifying arrangement increases a slope of the BOOST signal generated by the comparison arrangement and any prior amplifying arrangement prior to the BOOST signal pulse being transmitted to the plurality of generators.

16. The apparatus of claim 14 wherein each detector circuit further comprises:

a SPEED signal generating circuit comprising:

a NAND gate comprising a first input for receiving the BOOST signal from the comparison arrangement, a second input, and an output;

a delay circuit for introducing a predetermined delay into the BOOST signal received from the comparison arrangement for transmission to the second input of the NAND gate; and an inverter responsive to a logical output signal from the output of the NAND gate for generating a SPEED output control signal from the SPEED signal generating circuit for transmission to the plurality of generators.

17. The apparatus of claim 14 wherein each generator comprises:

a comparison circuit for comparing a reference voltage with an output voltage of the generator, and generating a output control signal when a voltage drop above a predetermined value is detected in the output voltage of the generator; and a P-channel Field Effect Transistor which is responsive to the control output signal from the comparison circuit for increasing the output voltage of the generator to the power bus to compensate for the voltage drop.

18. The apparatus of claim 17 where each generator further comprises:

a first N-channel Field Effect Transistor which is responsive to the BOOST signal generated by an OR-combination of the first and second detector circuits indicating that a voltage drop is detected for generating a feedback control signal to the comparison circuit for causing the comparison circuit to generate the output control signal to the P-channel Field Effect Transistor to increase the power on the power bus and compensate for the voltage drop; and a second N-channel Field Effect Transistor which is responsive to an externally generated SPEED control signal for generating a feedback control signal to the comparison circuit for causing the generator to generate a predetermined maximum output current to the power bus.

19. A method for controlling voltage generators of a generator system on a chip comprising the steps of:

(a) generating a predetermined amount of power from at least one generator for transmission along a power bus comprising a "spine" section on the chip which intersects with an "arm" section on the chip to load circuits in areas adjacent the "spine" and "arm" sections;

(b) obtaining a continuous measurement of a voltage drop occurring at a remote end of the "arm" section via a feedback lead to at least the intersection of the "spine" and "arm" sections for providing a continuous measurement of a voltage drop occurring at each end of the "arm" section;

(c) comparing a voltage from the at least one generator measured at the intersection of the "spine" and "arm" sections with the concurrent voltage drop measured at each end of the "arm" section in at least one detector circuit located adjacent the intersection of the "spine" and "arm" section of the chip for providing control signals to the at least one generator indicating load changes caused by the circuits in the adjacent sections of the chip; and (d) altering a generated voltage of the at least one generator to maintain a predetermined power level on the power bus in response to load changes caused by the circuits in the adjacent sections of the chip.

20. The method of claim 19 wherein in step (b) performing the substeps of:

(b1) comparing a voltage of the at least one generator measured at the intersection of the "arm" and "spine" with a voltage measured at an associated end of the "arm" section in a comparison arrangement; and (b2) generating a BOOST signal to the at least one generator representing a voltage difference between the two voltages measured in step (b1) for causing the at least one generator to maintain a predetermined power level on the power bus.

21. The apparatus of claim 20 comprising the further substeps of:

(b3) increasing the slope of the BOOST signal generated by the comparison arrangement in at least one amplifying arrangement, each amplifying arrangement increasing the slope of the BOOST signal from the comparison arrangement and any prior amplifying arrangement prior to the BOOST signal being transmitted to the at least one generator.

22. The apparatus of claim 20 wherein in step (b) performing the further substeps of:

(b3) receiving the BOOST signal from the comparison arrangement at a first input of a NAND gate;

(b4) introducing a predetermined delay into the BOOST signal received from the comparison arrangement for transmission to a second input of the NAND gate; and (b5) receiving a logical output signal from an output of the NAND gate at an input of an inverter for generating a SPEED output control signal for transmission to the at least one generator to maintain a predetermined power level on the power bus.

23. The method of claim 19 wherein in performing step (a) performing the subsets in each at least one generator of:

(a1) comparing a reference voltage with an output voltage of the generator in a comparison circuit, and generating a output control signal when a voltage drop above a predetermined value is detected in the output voltage of the generator; and (a2) increasing the output voltage of the generator to the power bus to compensate for the voltage drop via a P-channel Field Effect Transistor which is responsive to the output control signal from the comparison circuit.

24. The apparatus of claim 23 comprising the further substeps of:

(a3) causing the comparison circuit to generate the output control signal to compensate for the voltage drop via a first N-channel Field Effect Transistor which is responsive to a BOOST control signal generated in step (c) indicating that a voltage drop is detected; and (a4) causing the generator to generate a predetermined maximum output current to the power bus via a second N-channel Field Effect Transistor which is responsive to an externally generated SPEED control signal.

* * * * *